United States Patent [19]

Koppenhofer

[11] Patent Number: 4,733,712

[45] Date of Patent: Mar. 29, 1988

[54] METHOD OF CASTING MULTIPLE ARTICLES

[75] Inventor: Roger L. Koppenhofer, Saginaw, Mich.

[73] Assignee: Eaton Corporation, Cleveland, Ohio

[21] Appl. No.: 890,197

[22] Filed: Jul. 25, 1986

[51] Int. Cl.[4] ..... B22C 9/02; B22C 9/20

[52] U.S. Cl. ..... 164/16; 164/27; 164/129; 164/130; 164/137

[58] Field of Search ..... 164/16, 27, 129, 130, 164/137

[56] References Cited

U.S. PATENT DOCUMENTS 3,540,516 11/1970 Taccone ..... 164/130 X
3,672,441 6/1972 Wells et al. ..... 164/129 X
4,609,030 9/1986 Heater et al. ..... 164/137

FOREIGN PATENT DOCUMENTS 361936 11/1931 United Kingdom ..... 164/27

*Primary Examiner*—J. Reed Batten, Jr.
*Attorney, Agent, or Firm*—D. A. Rowe; F. M. Sajovec

[57] ABSTRACT

A plurality of identical green sand molds are sequentially formed by horizontal compaction on automatic mold making machinery. Each mold has a front and back vertical face with a recess formed in the front face and a plurality of down runners formed in the back face. A mold piece insert is formed of a mixture of green sand and a chemical bonding agent, preferably a resin binder and cold set in a pattern box to form the cavities for the cast articles. The mold piece insert is received flush in the mold front face recess with the cavities opening to the front face. A plurality of molds, with inserts, are adjoined in front-to-back relationship with the down runners overlapping the cavities for feeding the molten pour thereto.

10 Claims, 6 Drawing Figures

METHOD OF CASTING MULTIPLE ARTICLES

BACKGROUND OF THE INVENTION

The present invention relates to foundry practice and in particular, a way of casting hardenable iron articles to precise dimensions in sand molds. The invention pertains more particularly to foundry practice as employed for casting hardenable iron for making bodies for engine tappets of the type having a roller follower provided on one end of the tappet for contacting a rotating cam shaft. Hardenable iron bodies for roller-follower tappets are required to be cast with a pocket or socket formed in one end thereof for receiving the roller-follower partially therein. The wall of the end pocket is then cross bored for the roller-follower axle.

When it is desired to convert tappets for an existing production engine having a flat hardened face for sliding friction contact with the cam shaft lobes, to roller-follower configuration, it has been found difficult to form the necessary pocket in the end of the tappet for receiving the roller-follower and yet provide sufficient material strength in the wall surrounding the pocket for supporting the roller-follower axle. In order to maximize the size of the roller-follower for a given size or diameter tappet, the wall of the pocket formed in the end of the tappet for receiving the roller-follower has remained sufficiently thin that stress cracking has occurred in the portions of the walls supporting the roller-follower axle. Accordingly, it has therefore been necessary to tightly control the tolerances on the thickness of the wall surrounding the pocket, which has in turn, required close tolerance control and accurate positioning of the correspondingly shaped form in the sand mold in order to maintain the desired tolerances on the wall of the pocket in the cast article.

Where the hardenable iron tappet body is cast in sand molds, it has been found difficult to accurately control the position of the form or pattern in the sand mold to create the pocket in the end of the tappet. It has also been found difficult to maintain the tolerances on the portion of the sand mold forming the pocket. This has been found to be particularly difficult where the tolerances on the pocket dimension of the as-cast article cannot exceed ±0.010 inch (±0.259 mm). The problem of locating the tappet pocket forming in a sand mold has been particularly troublesome where a sand mold is desired having a plurality of mold cavities for simultaneously pouring several tappet bodies in one sand mold.

Thus, it has been desired to find a way or means of forming a precision mold cavity in a sand mold and particularly for casting the roller-follower receiving pocket in a hardenable iron tappet body.

SUMMARY OF THE INVENTION

The present invention provides a unique and novel way or process for casting precision articles of manufacture such as hardenable iron bodies for roller-follower type engine valve gear tappets. The present invention provides a foundry practice method for sand mold casting of hardenable iron where the sand mold must provide precision location of a pocket or recess in the article to be cast and also maintain tight tolerances on the dimensions of the articles to be cast.

The method of the present invention is readily adaptable to foundry practice in which individual sand molds are horizontally compacted by automatic machinery to provide rapid mold making. The present invention is particularly readily adaptable to automatic horizontal compaction of sand molds wherein each mold has a plurality of horizontally extending cavities therein, which are interconnected by down runners for receiving the molten pour.

The unique process of the present invention enables the sand mold to be compacted about a pattern forming a recess in the mold face for receiving a precision mold insert piece having the cavities formed therein for forming the articles to be cast. In a particular application of the present invention, the articles to be cast are hardenable iron tappet bodies. The mold insert piece in the present invention is formed of cold set or unheated resinous material mixed with sand, which is capable of forming and maintaining the mold cavity to the precision shape and dimensional control required for maintaining the tight tolerances required on the part to be cast. In particular, the mold piece insert is capable of maintaining the tight control required on the mold cavity for casting a precision pocket or recess in the end of the hardenable iron tappet body for assembly of a roller-follower and axle therein.

The present invention thus provides a unique and novel way of rapidly making plural cavity sand molds which have the capability of maintaining heretofore unobtainable dimensional control of the part to be cast by utilizing a mold piece insert formed of cold setting resin and sand, which is received in a recess formed in the face of the sand mold. The opposite face of the sand mold has green sand down runners formed therein. The molds are adjoined front-to-back to provide closures for the mold cavities; and, to enable continuous forming of the molds in sequence for operating a progressive pouring line.

DETAILED DESCRIPTION

Figure 1:
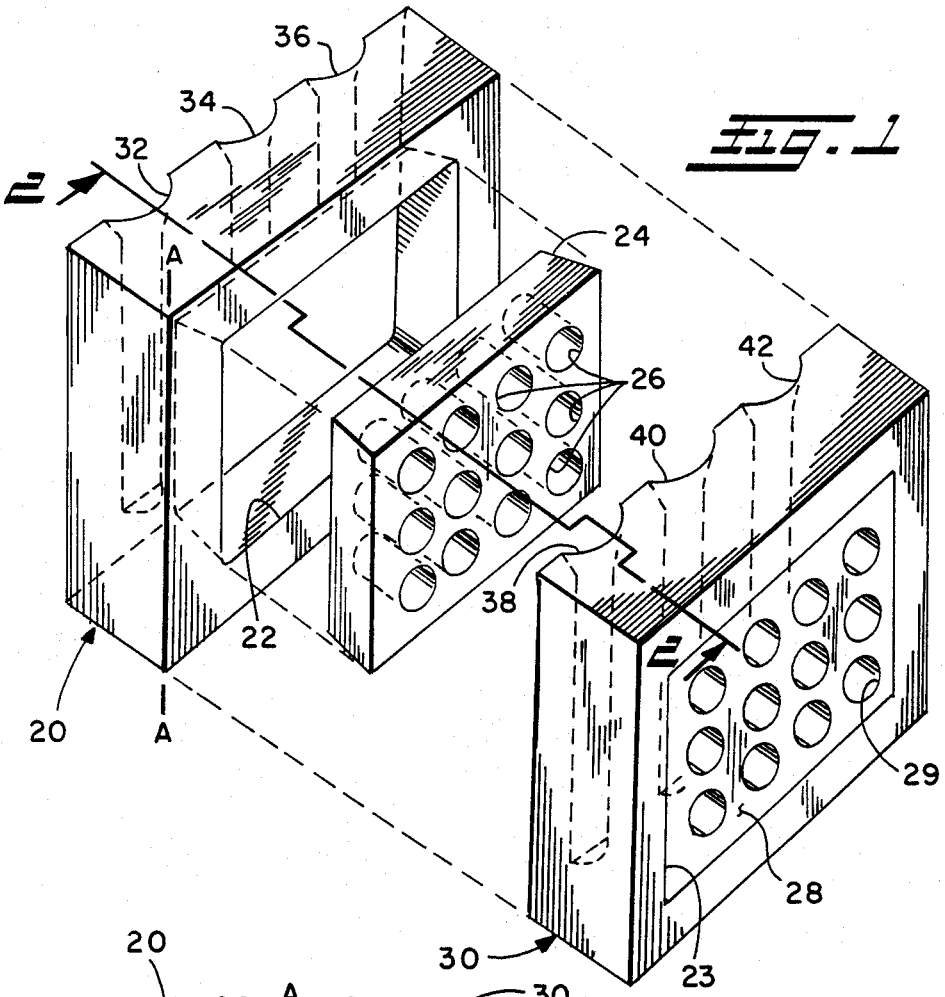
FIG. 1 is an exploded view of a pair of molds in horizontally adjoining arrangement with the mold piece insert shown removed from the front face of one of the molds.
Figure 2:
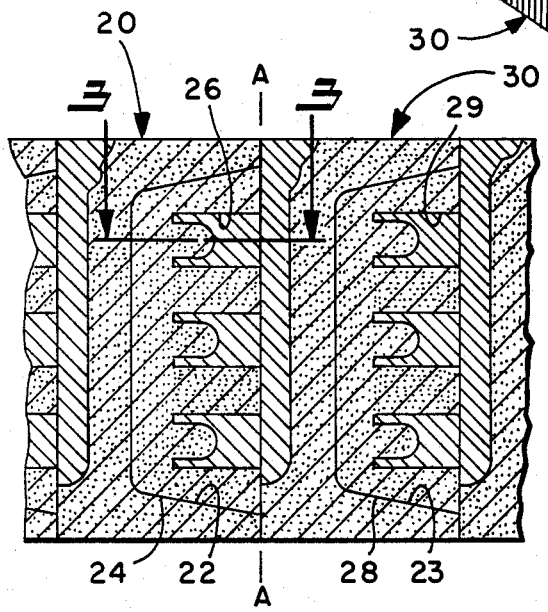
FIG. 2 is a section view taken along section-indicating lines 2—2 of FIG. 1 with the molds in adjoining relationship.

Referring to FIG. 1, a pair of molds indicated generally by the reference numerals 20, 30 are shown in back-to-front relationship and spaced apart horizontally from the vertical parting line along adjoining faces denoted by the reference characters A—A. The molds 20, 30 are identical and are representative generally of a plurality of such molds which may be arranged in similar front-to-back adjoining relationship to provide a line of molds to be poured with molten iron and particularly, molten iron which may be subsequently heat treated for hardness. Each of the molds 20, 30 is formed of green foundry sand having a recess 22, 23 formed in the front face thereof, and the molds 20, 30 sand are preferably compacted on a pattern forming the recess 22, 23.

Mold insert pieces 24, 28 are formed, in the presently preferred practice, of a mixture of foundry sand and a suitable binder which sets or cures to chemically bond the sand without the application of heat and is otherwise known as a cold set. In the present practice, it has been found satisfactory to employ a phenolic resin as a binder or chemical bonding agent for the sand in what is sometimes referred to as the "no-bake" process or the "cold box" technique. In the present practice, it has been found satisfactory for the no-bake process to utilize a resin sold under the tradename Pepset manufactured by Ashland Chemical Company, Foundry Division, P.O. Box 2219 Columbus, Ohio 43216 or a resin sold under the tradename Isocure by Ashland for the "cold-box" process. In the no-bake process, resin and hardener are mixed with green foundry sand and allowed to set over a period of time in a pattern at room temperature.

In the cold-box process, resin and sand are mixed in the pattern box and the hardener is applied as a gas purge to effect setting. The pattern box forms the cavities 26, 29 in the mold piece insert. The mold piece insert is formed in a separate pattern box and after room temperature set or curing, is removed therefrom and placed in the sand mold such as 20 or 30. In the presently preferred practice, the sand molds 20, 30 are formed by compaction between horizontally spaced vertically disposed platens of a horizontal molding press, which may be of any suitable type employed in the foundry art; however, it has been found particularly convenient to employ an automatic sand molding machine sold under the tradename "Disamatic" well known to those in the foundry art.

Figure 3:
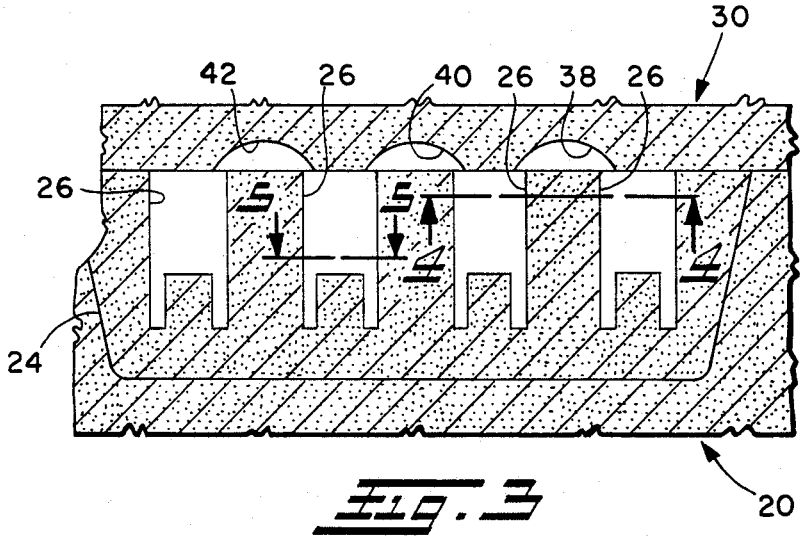
FIG. 3 is a section view taken along section-indicating lines 3—3 of FIG. 2.
Figure 4:
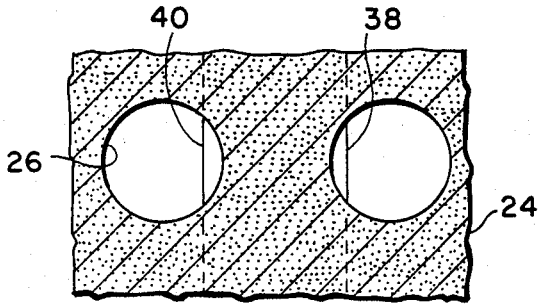
FIG. 4 is a section view taken along section indicating lines 4—4 of FIG. 3.
Figure 5:
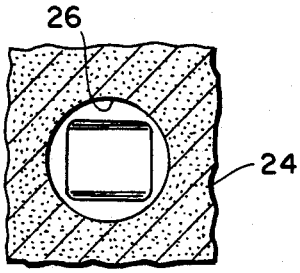
FIG. 5 is a fragmentary section view taken along section indicating lines 5—5 of FIG. 3; and, FIG. 6 is an axonometric view of the finished cast article to be made in the molds of FIG. 1.

The rear or backface of the molds 20, 30 has formed thereon by the compaction process described above, a plurality of vertically disposed down runner cavities denoted by the reference numerals 32, 34, 36 on mold 20, and numerals 38, 40, 42 on mold 30. The down runners are generally flared to a larger opening at the upper face of the mold to facilitate pouring and may optionally be interconnected to a center pouring cup into which iron is poured. Referring to FIGS. 3, 4 and 5, the down runners are positioned such that the vertical edges thereof overlap the mold cavities 26 to provide flow of the molten pour from the runners into the cavities 26, 29. The arrangement of FIGS. 3 and 4 has been found to be particularly satisfactory for precision casting of articles having the cylindrical shape of a tappet as shown in FIG. 6.

Figure 6:
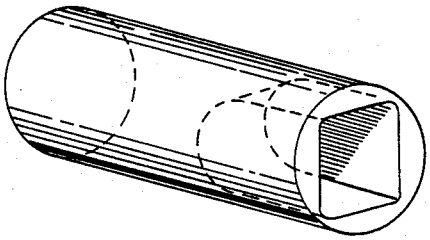

With reference to FIG. 5, the rectangular shape in the bottom of the cavity 26 is illustrated for forming the pocket for receiving the roller-follower in a cast tappet as shown in FIG. 6.

The present invention thus provides a unique and novel foundry practice wherein precision control of configuration and dimensional tolerances is obtained in casting articles formed of iron which has been heretofore unobtainable with sand mold casting. The present invention employs a chemically bonded mold piece insert which is received in a recess provided in a automatically compacted green sand mold. The mold piece insert is received in the front face of the sand mold and during the compaction process a plurality of down runners are formed on the backface of the sand mold. A pair of such molds are adjoined with front-face of one adjoining the backface of another of such molds. A plurality of identical molds may thus be adjoined in a horizontal chain to provide for sequential pouring of a plurality of molds. The method of the present invention lends itself readily to automatic machinery for compacting vertically disposed sand molds and yet provides pour cavities which provide dimensional control of the cast articles heretofore not obtainable.

Although the invention has been hereinabove described with respect to the illustrated embodiments, it will be understood that modifications and variations to the invention may be made and the invention is limited only by the following claims.

I claim:

1. A method of casting articles formed of hardenable cast iron:

(a) forming a plurality of green sand molds each with a front and back vertical face;

(b) forming a recess in the front face of one of said molds;

(c) chemically bonding sand and forming a mold piece insert having a plurality of precision mold cavities therein and disposing said mold piece insert in said mold recess with said cavities open to said front face;

(d) forming a down-runner in the back face of another of said sand molds and disposing said molds in front-to-back parting line arrangement and partially overlapping each of said mold cavities with said runner;

(e) pouring molten hardenable cast iron into said down runner and filling said cavities; and, (f) cooling and solidifying said molten hardenable cast iron and crumbling said sand molds about said mold piece insert and removing said cast articles from said mold piece insert.

2. The method defined in claim 1, wherein said step of chemically bonding sand and forming a mold piece insert includes the step of bonding sand with a phenolic resin.

3. The method defined in claim 1, wherein the step of forming a plurality of green sand molds includes the steps of horizontally compacting sand between vertical platens configured to form said front face recess and said down runner and removing said platens.

4. The method of casting hardenable iron to form articles of manufacture comprising the steps of:

(a) forming a plurality of sand molds each with a front and back vertical face;

(b) forming an insert-receiving recess in said front face and forming at least one down runner in said back face of each of said molds;

(c) bonding sand with phenolic resin and forming a mold piece insert having a plurality of precision mold cavities therein;

(d) disposing said insert in the recess of at least one of said molds and orienting said cavities to said front face;

(e) adjoining at least two of said molds in a front-to-back vertical parting line;

(f) pouring molten hardenable iron in said runner and filling said insert cavities; and, (g) cooling and solidifying said molten hardenable iron and removing said cast articles.

5. The method of casting hardenable iron to form articles of manufacture comprising the steps of:

(a) compacting a plurality of sand molds each with a front and back vertical face and forming a recess in said front face and forming at least one down runner in said back face of each of said molds;

(b) bonding sand with a resinous material and forming therewith a mold piece insert having a plurality of precision mold cavities therein;

(c) disposing said insert in the recess of at least one of said molds and orienting said cavities to said front face;

(d) adjoining the front face of said molds and insert in a vertical parting line arrangement with the back face of another of said molds;

(e) pouring molten iron in said runner and filling said insert cavities therewith;

(f) cooling and solidifying said molten iron and removing said cast articles.

6. The method defined in claim 5, wherein the step of bonding sand with a resinous material and forming a mold piece insert includes the steps of bonding sand with a phenolic resin material.

7. The method defined in claim 5, wherein the step of adjoining at least two of said molds includes the step of partially overlapping a column of said cavities on opposite sides of said down runner.

8. The method of casting iron to form articles of manufacture comprising the steps of:

(a) compacting in sequence a plurality of sand molds each with a front and back face and simultaneously with said compacting, forming an insert receiving recess in said front face and at least one down runner in said back face;

(b) chemically bonding sand with an unheated binder material and forming therewith a mold piece insert having a plurality of precision mold cavities therein;

(c) disposing said insert in the recess of at least one of said molds and orienting said cavities toward said front face;

(d) adjoining the front face of said at least one mold and insert with the back face of another of said molds and forming a vertical parting line therebetween;

(e) pouring molten iron in said runner and filling said insert cavities therewith;

(f) cooling and solidifying said molten iron and removing said cast articles.

9. The method defined in claim 8, wherein said step of compacting includes the step of forming said insert receiving recess with one platen of a horizontal press and forming said down runner with an oppositely disposed platen of said press.

10. The method defined in claim 8, wherein said step of chemically bonding sand includes the step of cold bonding said sand with resinous material.

* * * * *